United States Patent [19]

Scheiwiller

[11] Patent Number: 4,922,678

[45] Date of Patent: May 8, 1990

[54] STRUCTURAL ASSEMBLY FOR PRODUCING INTERCONNECTING STRUCTURES

[76] Inventor: Rolf Scheiwiller, Buolterlistrasse 9, CH-6052 Hergiswil, Switzerland

[21] Appl. No.: 425,378

[22] Filed: Oct. 19, 1989

Related U.S. Application Data

[63] Continuation of Ser. No. 168,515, Mar. 15, 1988, abandoned.

[30] Foreign Application Priority Data

Mar. 20, 1987 [EP] European Pat. Off. ..... 87810163.3

[51] Int. Cl.[5] ..... E04C 1/10

[52] U.S. Cl. ..... 52/570; 52/586; 52/593; 52/604; 52/608

[58] Field of Search ..... 52/570, 571, 572, 593, 52/604, 605, 606, 608, 586

[56] References Cited

U.S. PATENT DOCUMENTS

| | | | |
|---|---|---|---|
| 508,446 | 11/1893 | Straw | 52/570 |
| 707,444 | 8/1902 | Moses . | |
| 708,194 | 9/1902 | Bennett | 52/604 |
| 1,419,079 | 6/1922 | Roeth | 52/570 |
| 2,033,831 | 3/1936 | Jensen . | |
| 2,047,882 | 7/1936 | McPherson | 52/606 |
| 2,392,551 | 1/1946 | Roe | 52/586 |
| 3,411,254 | 11/1968 | Kessler | 72/586 |
| 3,534,518 | 10/1970 | Zagray . | |
| 3,557,505 | 1/1971 | Kaul | 52/608 |
| 3,562,988 | 2/1971 | Gregoire . | |
| 4,052,131 | 10/1977 | Lowrigkeit | 404/34 |
| 4,147,007 | 4/1979 | Eppich | 52/570 |
| 4,485,604 | 12/1984 | Palamara et al. | 52/606 |
| 4,532,747 | 8/1985 | Koetje | 52/586 |
| 4,524,551 | 6/1985 | Scheiwiller | 52/98 |
| 4,633,630 | 1/1987 | Kindylides | 52/570 |

FOREIGN PATENT DOCUMENTS

| | | | |
|---|---|---|---|
| 89391 | 9/1922 | Austria | 52/570 |
| 0065199 | 5/1982 | European Pat. Off. . | |
| 215994 | 9/1985 | European Pat. Off. . | |
| 816452 | 10/1948 | Fed. Rep. of Germany . | |
| 2230055 | 1/1974 | Fed. Rep. of Germany . | |
| 2533787 | 2/1977 | Fed. Rep. of Germany . | |
| 598990 | of 0000 | France . | |
| 1350543 | of 0000 | France . | |
| 687605 | 8/1930 | France . | |
| 2376269 | 7/1978 | France . | |
| 433891 | 4/1948 | Italy . | |
| 677455 | 8/1952 | United Kingdom | 52/570 |
| 783527 | 9/1957 | United Kingdom . | |
| 1386088 | 3/1975 | United Kingdom . | |

*Primary Examiner*—Carl D. Friedman
*Assistant Examiner*—Caroline D. Dennison
*Attorney, Agent, or Firm*—Marks Murase & White

[57] ABSTRACT

A structural assembly for producing interconnecting structures which includes a first element which, on each of two transversely extending sides lying opposite each other, is provided with a dovetail joint member and, on each of two longitudinally extending sides lying opposite each other, is provided with three fins which, when viewed from the tip or free end, have a convex portion provided on each side with a corresponding, connection recess so that the space between two adjacent fins is identical in form to the fin in order to permit a toothing to be formed. The structural assembly also includes a second element which is provided with a dovetail joint member on one longitudinally extending side and with three fins on the opposite side, as well as a connecting member which has, on each of two sides lying opposite each other, a dovetail joint member which corresponds to the dovetail joint members of the first element. Effective soundproofing walls or sloping walls can be produced simply in an interconnecting manner with such a structural assembly, and the individual elements can be produced economically.

10 Claims, 3 Drawing Sheets

FIG. 8
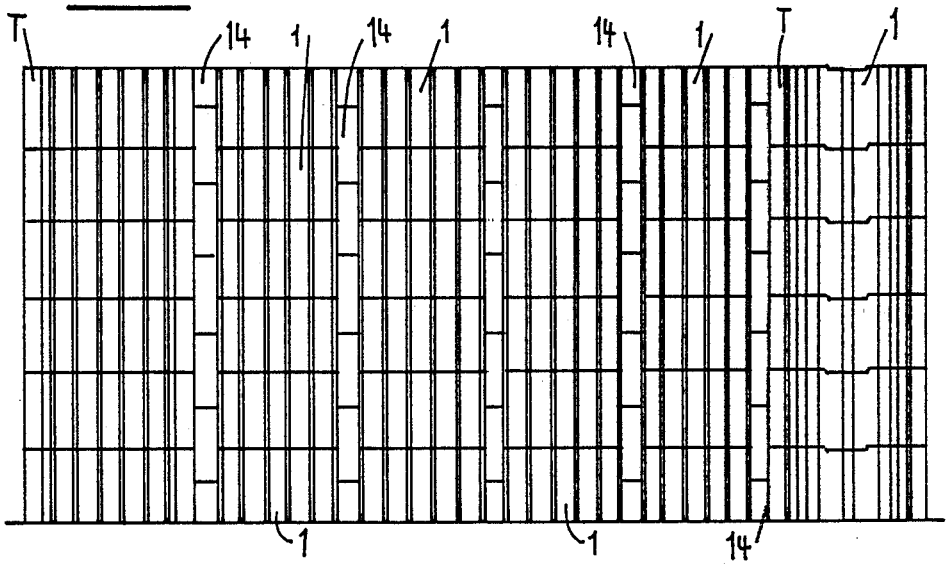
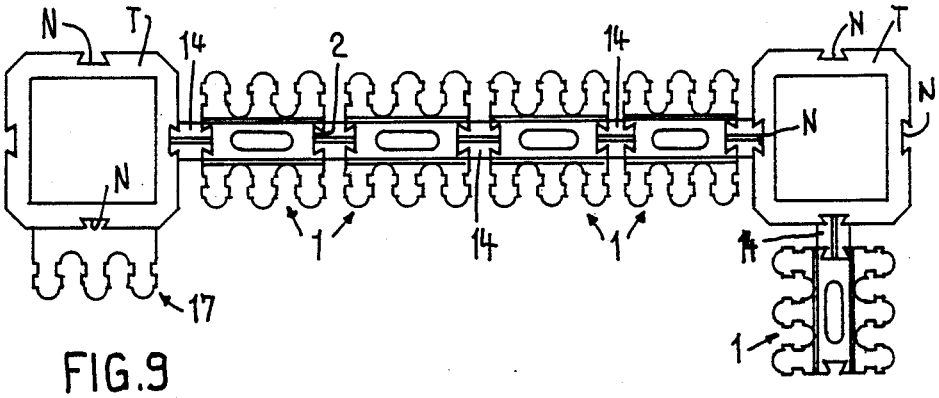
FIG. 9
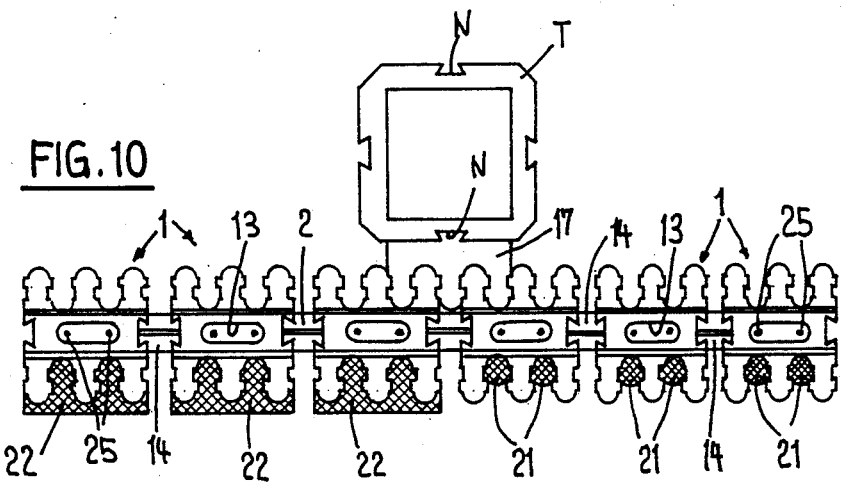
FIG. 10

FIG. 11
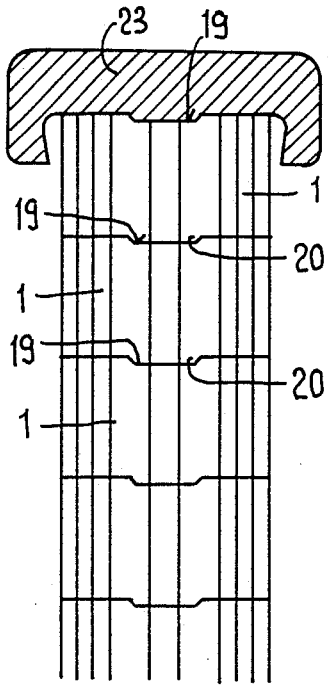
FIG. 12
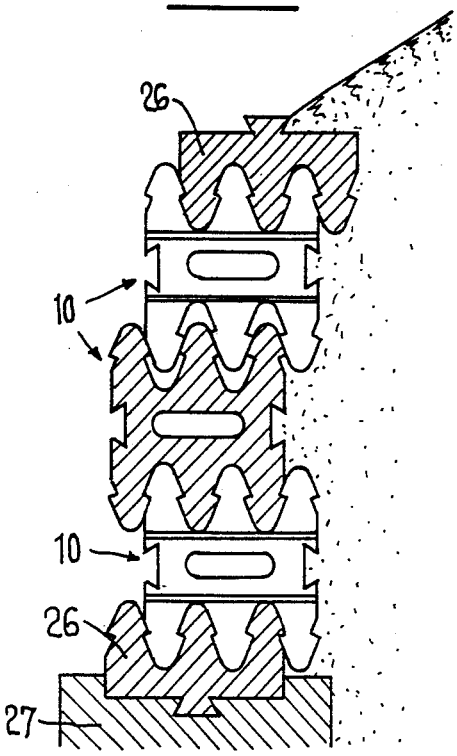
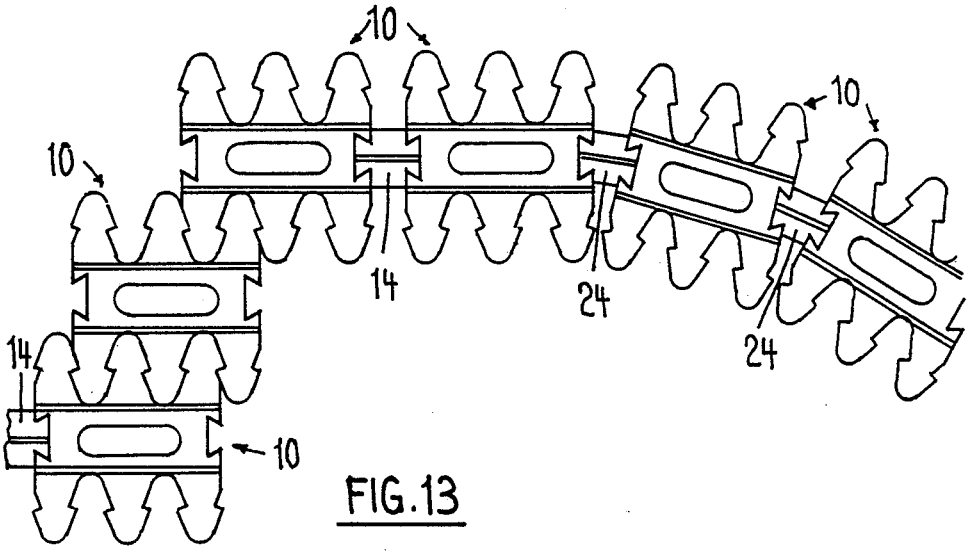
FIG. 13

STRUCTURAL ASSEMBLY FOR PRODUCING INTERCONNECTING STRUCTURES

This application is a continuation of application Ser. No. 07/168,515, filed 3-15-88 now aband.

FIELD OF THE INVENTION

The present invention relates to a structural assembly for producing interconnecting structures, the elements of the structural assembly being interconnectable by means of dovetail joints. It is particularly suitable for free-standing walls, which may be produced using dry-stone construction methods, and for soundproofing walls.

BACKGROUND OF THE INVENTION AND PRIOR ART DISCUSSION

A large number of structural assemblies having a wide variety of different elements for producing walls such as, for example, free-standing walls or soundproofing walls are known, and structural assemblies are also known which permit the walls to be erected using dry-stone construction methods. Thus, for example, European Patent No. A-0 215 994 discloses a structural assembly for producing interconnecting structures, wherein elements are interconnectable by means of dovetail joints. These elements are trough-shaped, and they are capable of accommodating plants on both sides.

OBJECTS OF THE INVENTION

The present invention now seeks to provide a structural assembly which, on the one hand, is compatible with an above-mentioned structural assembly having dovetail joints and, on the other hand, can be assembled easily and without expensive accessories to form an effective soundproofing wall or an alternative wall which is also utilisable for making embankments. Furthermore, despite offering numerous possible applications, the structural assembly should comprise a relatively small number of elements and should be capable of being produced as economically and rationally as possible. These objects are achieved by means of a structural assembly as defined in the claims.

BRIEF DESCRIPTION OF THE DRAWINGS

The invention is now explained more fully in detail with reference to a drawing of embodiments.

FIG. 8 is a side elevational view of a soundproofing wall which has been produced from previously-known elements and from elements according to the invention;

FIG. 9 is a plan view of the wall shown in FIG. 8;

FIG. 10 shows an alternative form of a soundproofing wall;

FIG. 11 shows an end element of the structural assembly;

FIG. 12 shows an example of the elements according to the invention used to form a sloping wall; and FIG. 13 shows a further example of use.

DESCRIPTION OF PREFERRED EMBODIMENTS

Figure 1:
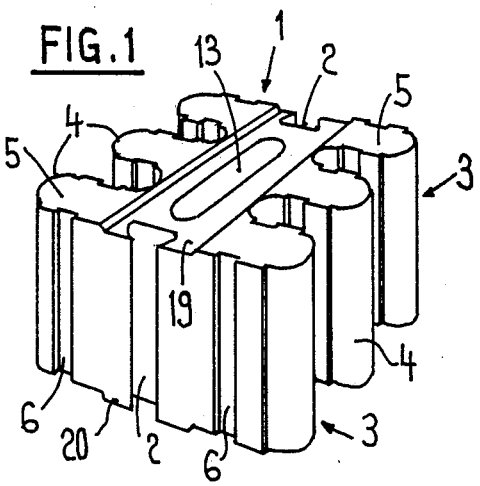
FIG. 1 is a perspective view of a first element of the structural assembly according to the invention.
Figure 2:
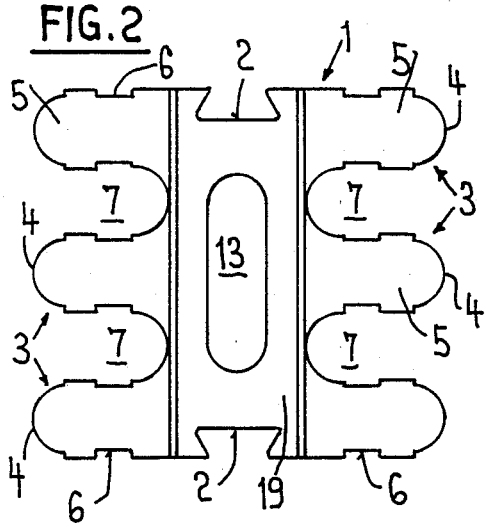
FIG. 2 is a plan view of the element shown in FIG. 1.
Figure 7:
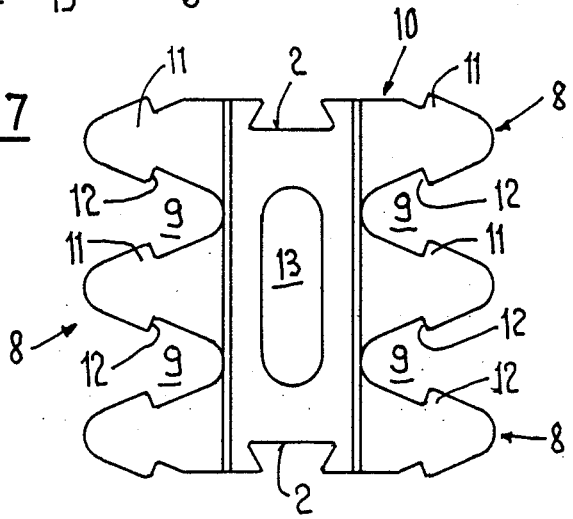
FIG. 7 is a plan view of an alternative form of the first element.

FIGS. 1 and 2 illustrate a first element 1 which has a dovetailed groove 2 in each of its two transversely extending sides and three fin-like projections 3 on each of its longitudinally extending sides. When viewed from outside, that is to say from the tip or free end 4, each fin 3 has a convex portion with a shoulder portion 5 disposed on either side of the fin. This shoulder portion 5 communicates with a corresponding recess 6, and it can be clearly seen from FIGS. 2 and 7 that the spaces 7 between the fins are absolutely identical in shape, when rotated through 180°, to the fins themselves, with the result that, in each case, a fin will fit exactly into the space between two fins. This applies also, of course, to the fins 8 and spaces 9 of the element 10 shown in FIG. 7, the shoulder portion 11 of which element or the recess 12 being saw-tooth-shaped. In addition to the illustrated form of the fins 3, which are provided with rectangular shoulder portions, and to the tapering form of the fins 8 with their saw-tooth-shaped shoulder portions, or respectively their recesses, it is feasible to have a number of other forms such as, for example, tapering, triangular forms or alternative forms. Furthermore, FIGS. 1, 2 and 7 show that the element 1 or 10 is provided with an elongate aperture 13 which, on the one hand, provides a reduction in weight and, on the other hand, serves to anchor, that is to say, stabilise, the stacked elements by means of reinforcing rods 25 and a concrete filling, whereby it is also possible for elements to be braced by means of threaded rods. Instead of the provision of an elongate aperture, it is also possible, of course, for a plurality of apertures, with different forms, to be provided in the central portion of the element 1 or 10.

Figure 3:
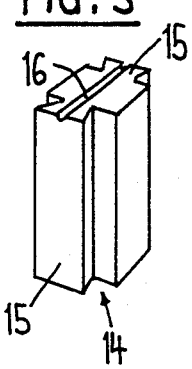
FIG. 3 is a perspective view of a connecting element.
Figure 4:
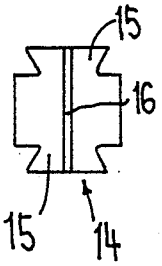
FIG. 4 is a plan view of the element shown in FIG. 3.

FIGS. 3 and 4 show a connecting element 14 which has a dovetail tongue 15 on each of its two opposed sides, the tongue fitting into the dovetailed groove 2. It is clear that a reversal of the two connecting members is also possible, that is to say that dovetail tongues are provided on the first element and dovetailed grooves are provided on the connecting element. In addition, the connecting element has a channel 16 at which it can be split.

Figure 5:
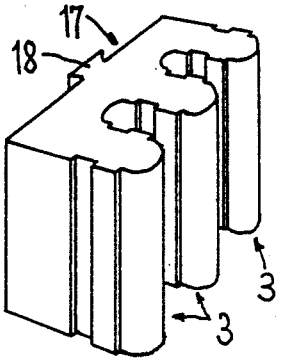
FIG. 5 is a perspective view of an additional element according to the invention.
Figure 6:
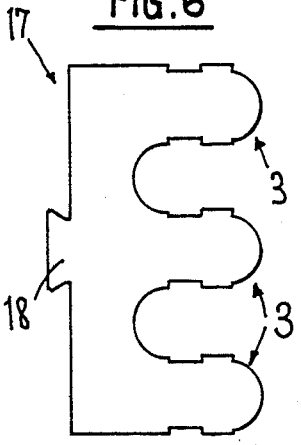
FIG. 6 is a plan view of the element shown in FIG. 5.

FIGS. 5 and 6 show a second element 17 which has a dovetail tongue 18 in the middle of one of its longitudinally extending sides nd three fins 3, or 8, on the other longitudinally extending side, just like the first element. It is evident that another second element can have a dovetail groove 2 instead of dovetail tongue 18. The second element 26 (FIG. 12) may also have the alternative form shown in FIG. 7.

It is also apparent from FIGS. 1, 2 and 7 that the first element has a wide, continuous groove 19 in the side shown uppermost in the drawing, and has a corresponding rib 20 on the underside. As can be seen from FIGS. 8 and 11, this arrangement also permits the stacked first elements to be locked vertically.

All the substances commonly used for producing interconnecting stones can be used as materials for such elements, especially lightweight concrete and also coarse-pored, sound-absorbent material. Elements each provided with three fins are shown in the above-mentioned embodiments, but elements with two, four or more fins may also be used. However, the ease of handling then decreases with the increase in the number of fins.

FIGS. 8 and 9 show the construction of a soundproofing wall, where parts of an alternative structural assembly are used to produce interconnecting structures which may be connected to troughs which can accommodate plants. FIGS. 8, 9 and 10 show a square, trough-shaped stone T which is disclosed in European Patent No. A-0 215 994 and which has, on each of its four sides, a dovetailed groove N which corresponds to the dovetailed groove 2 or, respectively, the dovetail tongue 15 of the elements shown in FIGS. 1 and 3. The first elements 1 can now be arranged on and above one another by means of the connecting elements 14, adjacent to these trough-shaped stones T. In FIG. 8, it is apparent that the connecting elements, in respect of the trough-shaped elements and the first fin elements, are offset from one another by an amount corresponding to half their height in order to achieve a good connection. It is further indicated in FIG. 9 that fin elements may also be arranged perpendicular to the soundproofing wall, and such fin elements additionally serve as sound-absorbent elements. This applies equally to the second element 17 which has been attached to the left-hand trough-shaped stone in FIG. 9. Both the trough-shaped stones and the fin elements may be cast, and reinforcing rods 25 may be used. FIG. 9, in particular, shows a further function of the shaped fins, that is to say, the convex portions and recesses of the fins, namely their capacity for largely absorbing, and in consequence eliminating, sound. As a consequence of the modular construction of the soundproofing wall, it is undoubtedly possible either to omit individual elements and incorporate a door instead, which has the same appearance, or to attach elements directly to hinges in order to serve as an emergency exit. The dimensions and the material for the fin elements may be selected so that elements are produced which are easy to handle and can be unloaded and assembled without any special aids, such as heavy-duty cranes and the like.

FIG. 10 illustrates further alternative forms. If, for exmple, it is desirable to provide either smooth walls or a reinforcement of the walls on one side, the elements 22 which do not have any dovetail tongue may be introduced into the first elements, as shown in the bottom left-hand corner of FIG. 10, so that their smooth exterior is outwardly visible. In such a case, either the dovetail tongue may be removed, or elements may be provided which do not have such a dovetail tongue 18. On the right-hand side of FIG. 10, sound-absorbent material, for example rods 21 are shown which are formed from rock-wool or the like and which may be pressed into the spaces between two fins. Instead of using the two-finned elements 22 shown on the left in FIG. 10, it is also possible, of course, to use 3- or 4-finned elements which can the achieve an even better connection effect.

FIG. 11 shows a coping stone 23 which, on the one hand, forms an aesthetically pleasing edge and, on the other hand, prevents rain and dirt from entering the wall from above. The lower end of the coping stone is provided with the rib 20, which fits into the groove 19, while the sides may be of any desired form and extend downwardly, as shown in FIG. 11.

FIG. 12 shows an alternative use of the elements according to the invention, namely their use to erect a sloping wall. It is an acknowledged fact that the elements may be indented completely by means of the fins, as in the case of the sound-absorbent wall, so that, in the present case, the upwardly and/or downwardly extending sides are the sides provided with the fins. In such a case, the lower ends of the second half elements 26 may serve as anchoring means in a footing 27, and the upper ends may serve as edging. Furthermore, it can be seen from FIG. 12 that it is not always necessary to achieve complete toothing between the fins of the elements, but the elements may also be stacked so that, even if the toothing of the fins is not complete, an interconnected wall is produced. In the example illustrated, the dovetail joint members are not necessary, but it is possible, of course; to connect anchoring or ornamental elements there by means of these dovetail joints.

FIG. 13 shows a further example of using the elements according to the invention. If the dovetail tongues of the connecting elements are somewhat smaller than the corresponding grooves in the first elements, it is possible to achieve a certain degree of curvature. If, however, a larger curvature is desired, asymmetrical connecting elements 24 may be provided which permit curvature in both directions. In such a case, as shown in FIG. 13, the upper end of the connecting element 24 is greater than its lower end, so that a curvature of the wall can be achieved.

It is also possible to produce the above-mentioned elements of the structural assembly from wood or plastics material, possibly on a reduced scale, and, in consequence, these elements may also be used as toys.

What I claim:

1. A structural assembly for producing interconnecting structures, comprising a first element which, on each of two transversely extending sides lying opposite to each other, is provided with a dovetail joint member used to connect said element to other elements, and on each of two longitudinally extending sides lying opposite each other, is provided with at least two fins having a convex portion provided on each side with a corresponding, connecting recess formed to correspond to the fins.

2. A structural assembly according to claim 1, wherein one side of the first element, not having either the dovetail joint members or the fins, is provided with a continuous groove, and an opposite side is provided with a corresponding rib.

3. A structural assembly according to claim 2, wherein the first element has an aperture at right angles to the groove and the rib.

4. A structural assembly according to claim 1, wherein a second element is provided with a dovetail joint member on one longitudinally extending side and with at least two fins on an opposite side.

5. A structural assembly according to claim 1, wherein a connecting element which has, on each of two sides lying opposite to each other, a dovetail joint member which corresponds to the dovetail joint members of the first element.

6. A structural assembly according to claim 5, wherein the connecting element is provided with a channel.

7. A structural assembly according to claim 5, wherein two sides of the connecting element which lie opposite each other have unequal lengths.

8. A structural assembly according to claim 1, wherein three fins are provided on each side of the first and second elements having fins, the first element being provided with dovetail grooves, and the connecting element being provided with dovetail tongues.

9. A structural assembly according to claim 1 wherein the assembly has a coping stone which, on its underside, has a rib corresponding to the groove of the first element.

10. A structural assembly according to claim 1, wherein the assembly is constructed from sound-absorbent material.

* * * * *